US010414059B2

(12) United States Patent
Rehbein et al.

(10) Patent No.: US 10,414,059 B2
(45) Date of Patent: Sep. 17, 2019

(54) BATTERY OPERATED RAZOR

(71) Applicant: The Gillette Company LLC, Boston, MA (US)

(72) Inventors: Stefan Rehbein, Bad Soden am Tanaus (DE); Guohua Shen, Shanghai (CN); Wei Gu, Immunos (SG); Fred Dieter Schnak, Kronberg (DE); Gerrit Roenneberg, Darmstadt (DE)

(73) Assignee: The Gillette Company LLC, Boston, MA (US)

( * ) Notice: Subject to any disclaimer, the term of this patent is extended or adjusted under 35 U.S.C. 154(b) by 121 days.

(21) Appl. No.: 15/452,091

(22) Filed: Mar. 7, 2017

(65) Prior Publication Data

US 2017/0173810 A1 Jun. 22, 2017

Related U.S. Application Data

(62) Division of application No. 14/070,099, filed on Nov. 1, 2013, now Pat. No. 9,623,576.

(51) Int. Cl.
*B26B 21/22* (2006.01)
*B26B 21/52* (2006.01)

(52) U.S. Cl.
CPC ..... *B26B 21/526* (2013.01); *B26B 21/222* (2013.01)

(58) Field of Classification Search
CPC ..... A61C 17/04; A61C 17/32; A61C 17/34; A61C 17/40; A61C 17/24; B26B 21/405; B26B 21/526; B26B 19/3873; B26B 19/3853; B26B 21/52; B26B 21/256; H01M 2/1055
See application file for complete search history.

(56) References Cited

U.S. PATENT DOCUMENTS

| | | | |
|---|---|---|---|
| 5,476,729 | A | 12/1995 | Miller, Jr. et al. |
| 2003/0000033 | A1 | 1/2003 | Lev et al. |
| 2004/0154113 | A1 | 8/2004 | Drossler et al. |
| 2006/0246347 | A1 | 11/2006 | Diehl et al. |
| 2009/0070947 | A1 | 3/2009 | Baertschi et al. |

*Primary Examiner* — Jason Daniel Prone
*Assistant Examiner* — Samuel A Davies
(74) *Attorney, Agent, or Firm* — Ronald T. Sia; Kevin C. Johnson

(57) ABSTRACT

Handle is provided for battery operated razors. In some implementations, the handle includes a simple, efficient mechanism for both securing a battery cover to the handle of a razor and at the same time providing a high reliability electrical contact between the battery and electronics of the razor. The mechanism includes a closing system, including a first conductive component slidably attached within the battery cover and biased toward a predetermined axial position, and a second conductive component secured to the interior wall of the grip portion. The first conductive component is configured to interact with the second conductive component and move axially within the battery cover during engagement of the battery cover with the grip portion.

6 Claims, 6 Drawing Sheets

BATTERY OPERATED RAZOR

FIELD OF THE INVENTION

Figure 1A:
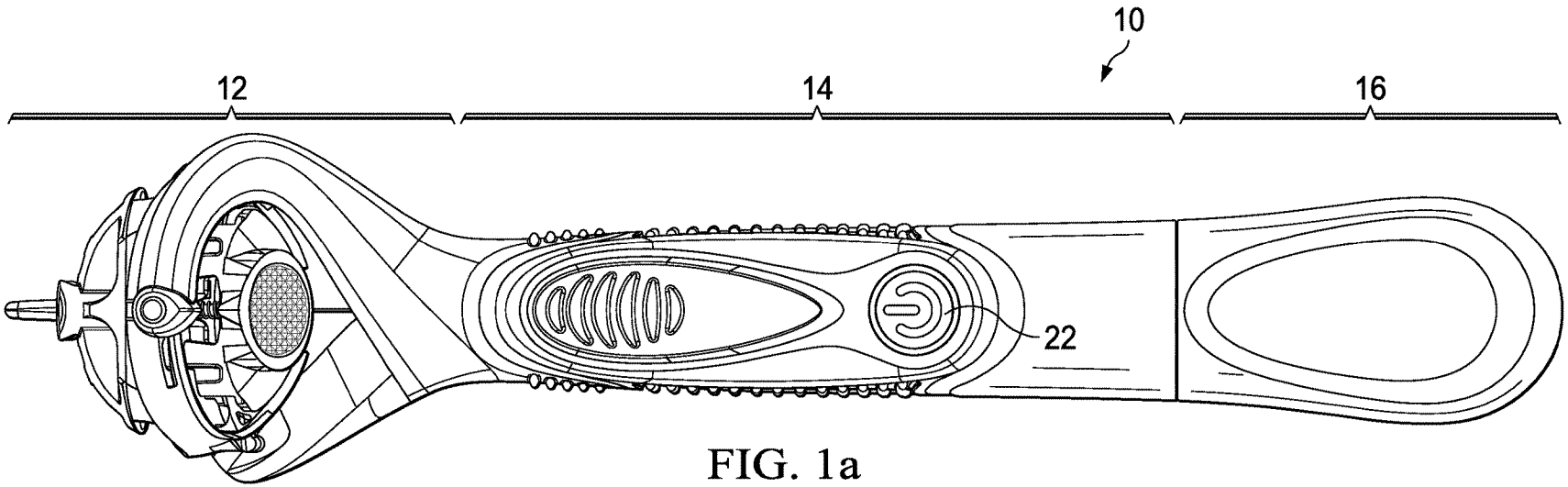

This invention relates to razors, and more particularly to razors for wet shaving that include a battery-powered functionality.

BACKGROUND OF THE INVENTION

In many small battery-operated devices, the batteries are replaceable by the user, and are inserted and removed from a battery compartment through an opening in a housing having a cover. It is necessary to mechanically secure the cover in place via a closing system so that the batteries do not fall out and the cover is not lost during use. Also, in the case of water-tight devices, the closure system provides a seal between the cover and the housing. It is also necessary to make electrical contact between the batteries and the electrical circuitry within the device, and to hold the batteries in place within the device. For many small battery-operated devices the closure system comprises a threaded connection. Since many small battery devices are made of plastic, the threaded connection is also plastic and can be somewhat fragile. As a result, the threaded closure system is subject to damage through repeated fastening and unfastening or if the connection is over torqued during tightening which a user may have a tendency to do since operation of the device is dependent on the connection. Therefore, there is a need for a closure system providing a mechanically secure connection on small battery-operated devices that signals the user when the closure system is adequately secure.

SUMMARY OF THE INVENTION

The present invention provides a simple, efficient mechanism for both securing a battery cover to the handle of a razor and at the same time providing a high reliability electrical contact between the battery and electronics of the razor. Preferred closing systems include very few parts and thus are easy and economical to manufacture and assemble. Moreover, some preferred closing systems are suitable for use with small, space saving handle designs and/or designs that includes seam lines between the battery cover and handle.

In one aspect, the invention features a battery operated razor comprising a housing including a grip portion (grip tube), a battery cover or shell and a closing system for fastening the battery cover to the grip tube. The grip tube is cylindrical and has an exterior wall defining a chamber having an interior wall and an open end. The battery cover is also cylindrical and has an exterior wall defining a cavity having an interior wall and an open end. The battery cover is removably mounted on the grip tube via the closing system and the grip tube chamber and battery cover cavity are configured to contain one or more batteries. The closing system comprises a first threaded portion at the grip tube chamber open end and a second threaded portion at the battery cover cavity open end mating with the first threaded portion. The closing system includes a first conductive component and a second conductive component. The first conductive component is slidably attached to the interior wall of the battery cover cavity and biased toward a predetermined axial position. The second conductive component is secured to the interior wall of the grip tube chamber;

The first conductive component comprises a contact surface facing and extending circumferentially about the battery cover cavity open end. The first conductive component contact surface comprises a first end and a second end opposite the first end and a kinked portion proximate the second end extending from the contact surface.

The second conductive component comprises a contact surface facing and extending circumferentially about the grip tube chamber open end. The second conductive component contact surface comprises a first end and a second end opposite the first end and a protrusion proximate the second end extending from the contact surface. As the first threaded portion at the grip tube chamber open end fastens to second threaded portion at the battery cover cavity open end during attachment of the battery cover to the grip tube, the first conductive component contact surface interfaces with the second conductive component contact surface such that the kinked portion of the first conductive component contact surface interferes with the second conductive component contact surface. The kinked portion slides circumferentially along the second conductive component contact surface deflecting the first conductive component axially. Once the kinked portion slides over the protuberance on the second conductive component contact surface an audible click is produced indicating that the attachment is complete.

In an alternate embodiment, the first conductive component comprises an L-shaped member extending circumferentially about the interior wall of the battery cover cavity proximate the battery cover open end providing a contact surface facing the open end. The first conductive component L-shaped member comprises a first end and a second end opposite the first end. The first end includes a vertical leg extending axially from the contact surface toward the open end of the cavity forming a first conductive component end stop and the second end includes a kinked portion proximate the second end extending axially away from the contact surface toward the battery cover open end. Similarly, the second conductive component comprises an L-shaped member extending circumferentially about the interior wall of the grip tube chamber and providing a contact surface facing the grip tube chamber open end. The L-shaped member comprises a first end and a second end opposite the first end. The first end includes a vertical leg extending axially from the contact surface away from the grip tube chamber open end forming a second conductive component end stop. The second end includes a protrusion proximate the second end extending from the contact surface, toward the grip tube chamber open end.

During attachment of the battery cover to the grip tube, the first conductive component contact surface interfaces with the second conductive component contact surface such that the kinked portion of the first conductive component contact surface interferes with the second conductive component contact surface. As the battery cover rotates relative to the grip tube, the kinked portion slides circumferentially along the second conductive component contact surface deflecting the first conductive component axially. Eventually the kinked portion slides over the protuberance on the second conductive component contact surface producing an audible click indicating that the attachment is complete. Either simultaneous with or shortly after the audible click, first conductive component end stop mates with the second conductive component end stop preventing further attachment of the cover to the grip tube.

In an alternate embodiment, the first conductive component comprises a first end, a second end and an elongate middle section therebetween, the elongate middle section is slidably attached to the interior wall of the battery cover. The first end comprises the L-shaped member previously described and the second end forms a U-shaped portion. The U-shaped portion has a first leg extending radially away from the elongate middle section to a bend and a second leg extending from the bend parallel to the first leg, back towards the elongate middle section. The second leg is attached to the interior surface of the battery cover allowing the first leg to deflect axially and to bias the first conductive component as it moves axially within the battery cover. The second leg includes a surface opposite the first leg providing a spring holder. The spring holder secures a spring for biasing the one or more batteries in grip tube chamber and battery cover cavity.

The details of one or more embodiments of the invention are set forth in the accompanying drawings and the description below. Other features, objects, and advantages of the invention will be apparent from the description and drawings, and from the claims.

DETAILED DESCRIPTION OF THE DRAWINGS

FIG. 1*a* is a top view of a razor handle according to one embodiment.

Figure 1B:
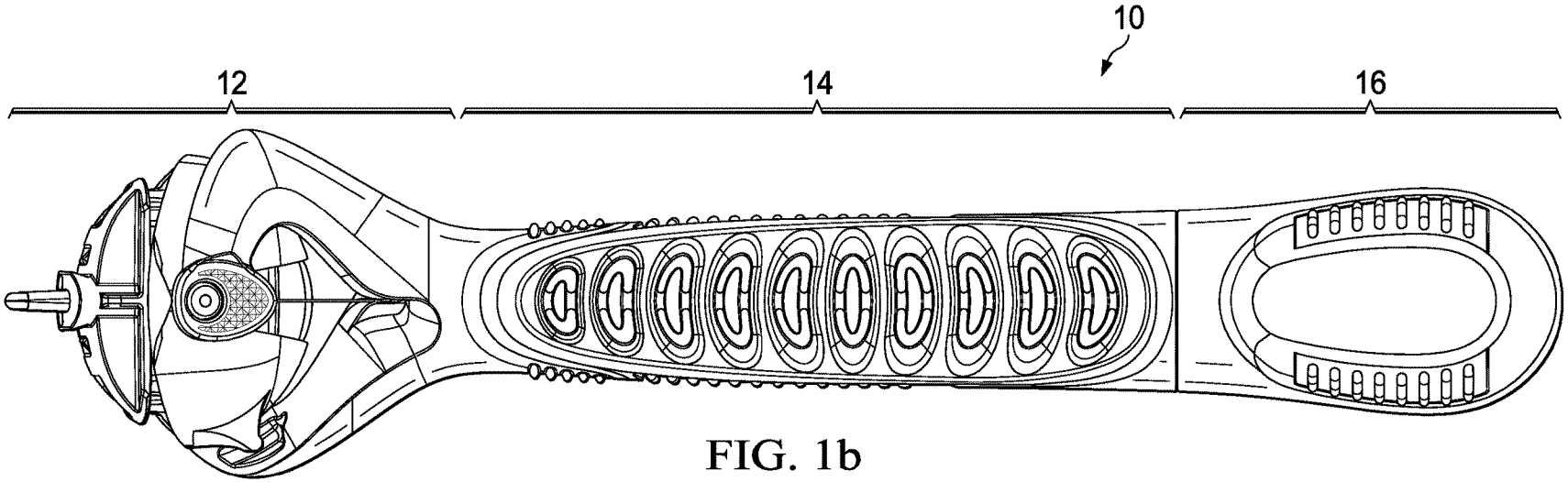

FIG. 1*b* is a bottom view of the razor handle of FIG. 1*a*.

Figure 2A:
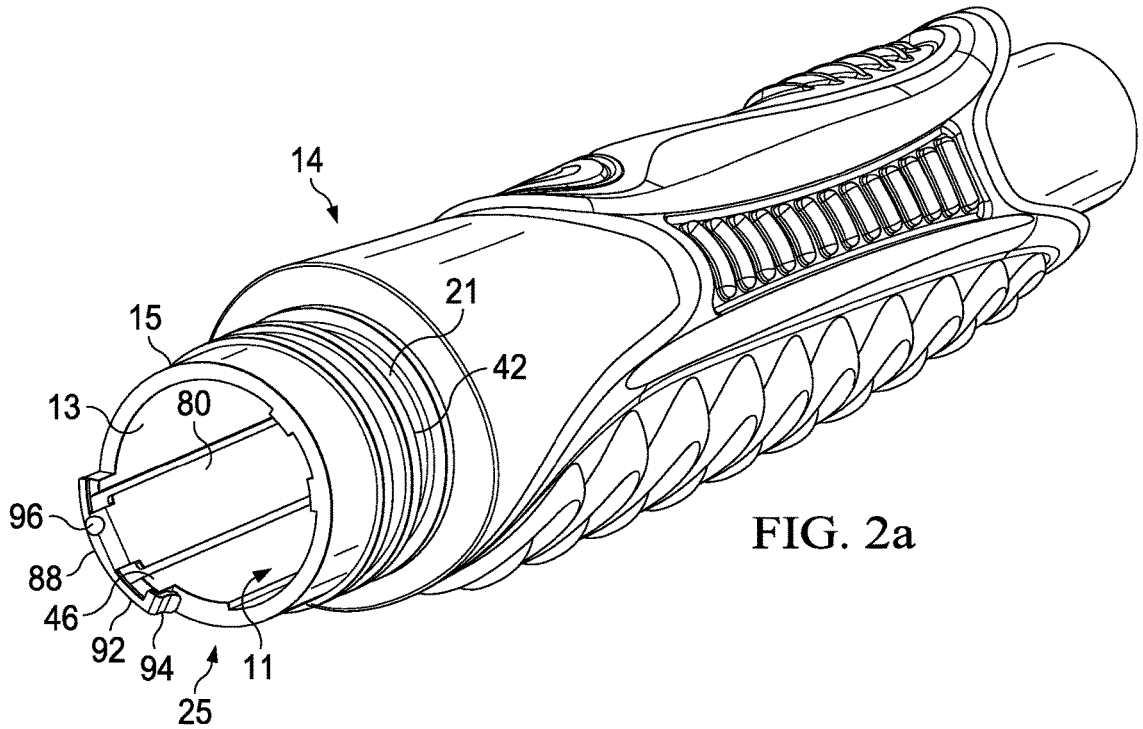

FIG. 2*a* is a perspective view of the grip tube of the razor handle of FIG. 1*a*.

Figure 2B:
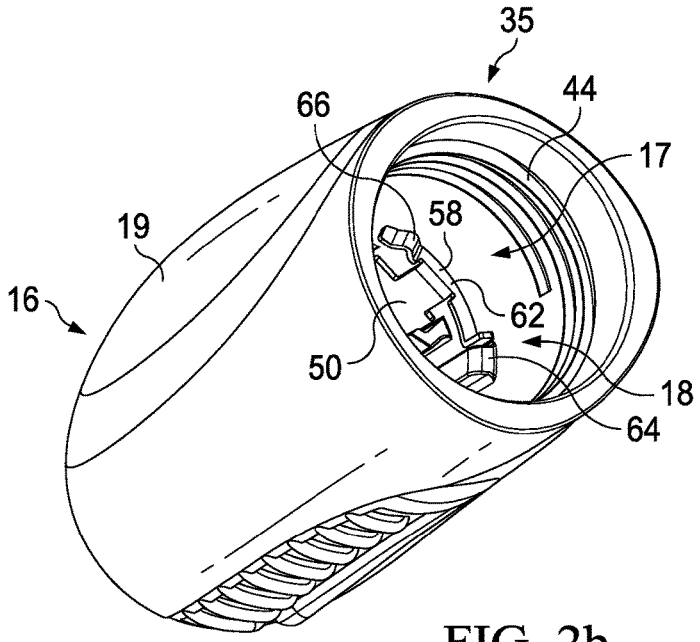

FIG. 2*b* is a perspective view of the battery cover of the razor handle of FIG. 1*a*.

Figure 3:
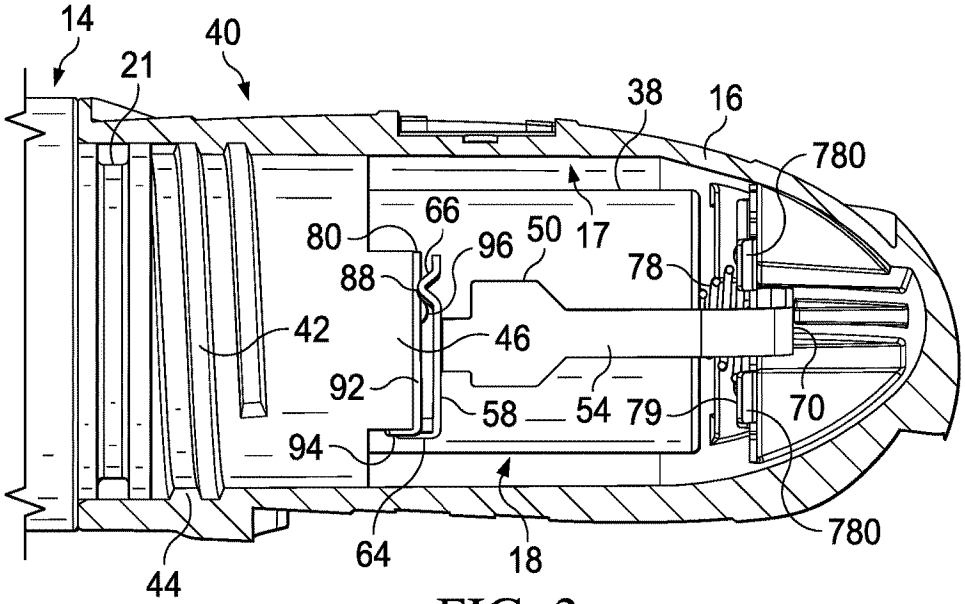

FIG. 3 is a cross section view of the batter cover and the threaded connection between the battery cover and the grip tube.

Figure 4A:
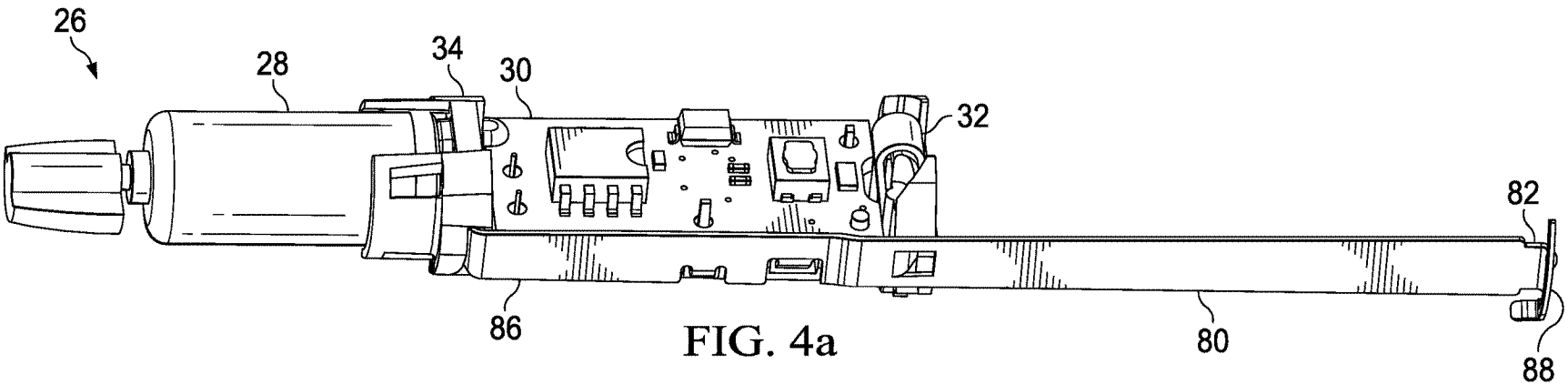

FIG. 4*a* is a perspective view of the subassembly of the electrical components contained in the grip tube.

Figure 4B:
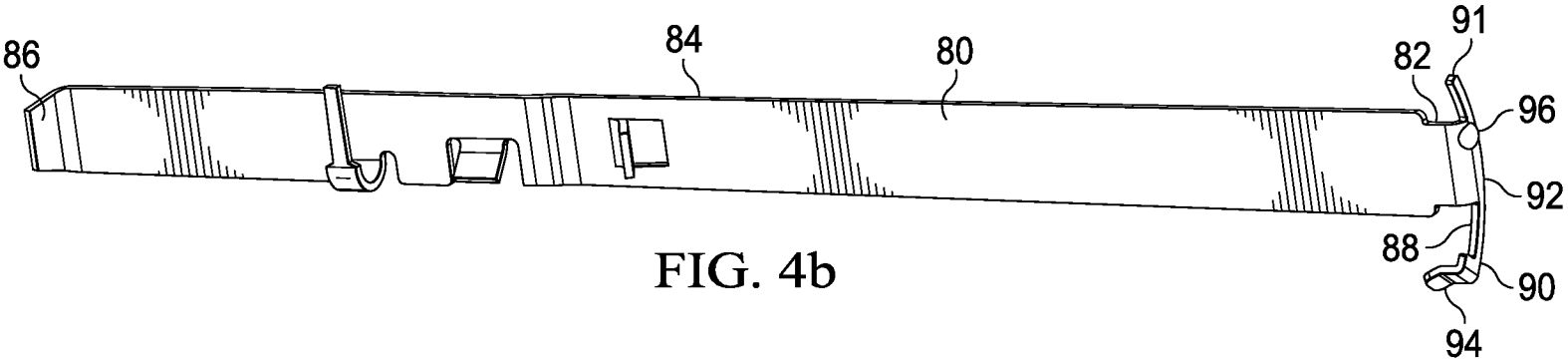

FIG. 4*b* is a perspective view of the second conductive component.

Figure 4C:
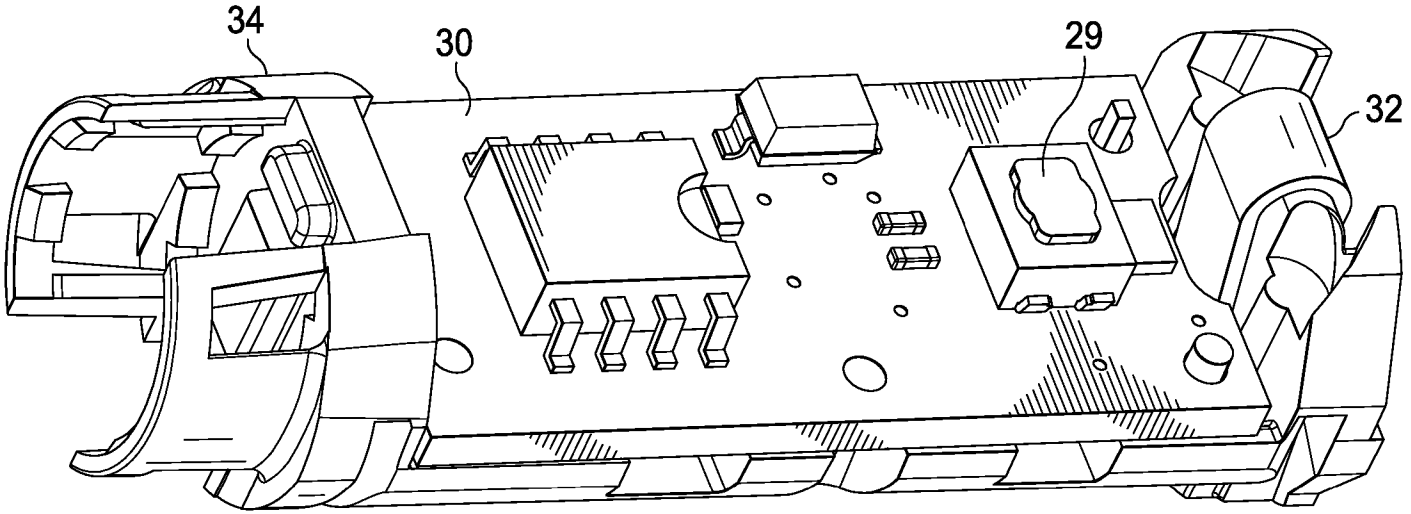

FIG. 4*c* is a perspective view of the printed circuit board (PCB) and PCB carrier.

Figure 5:
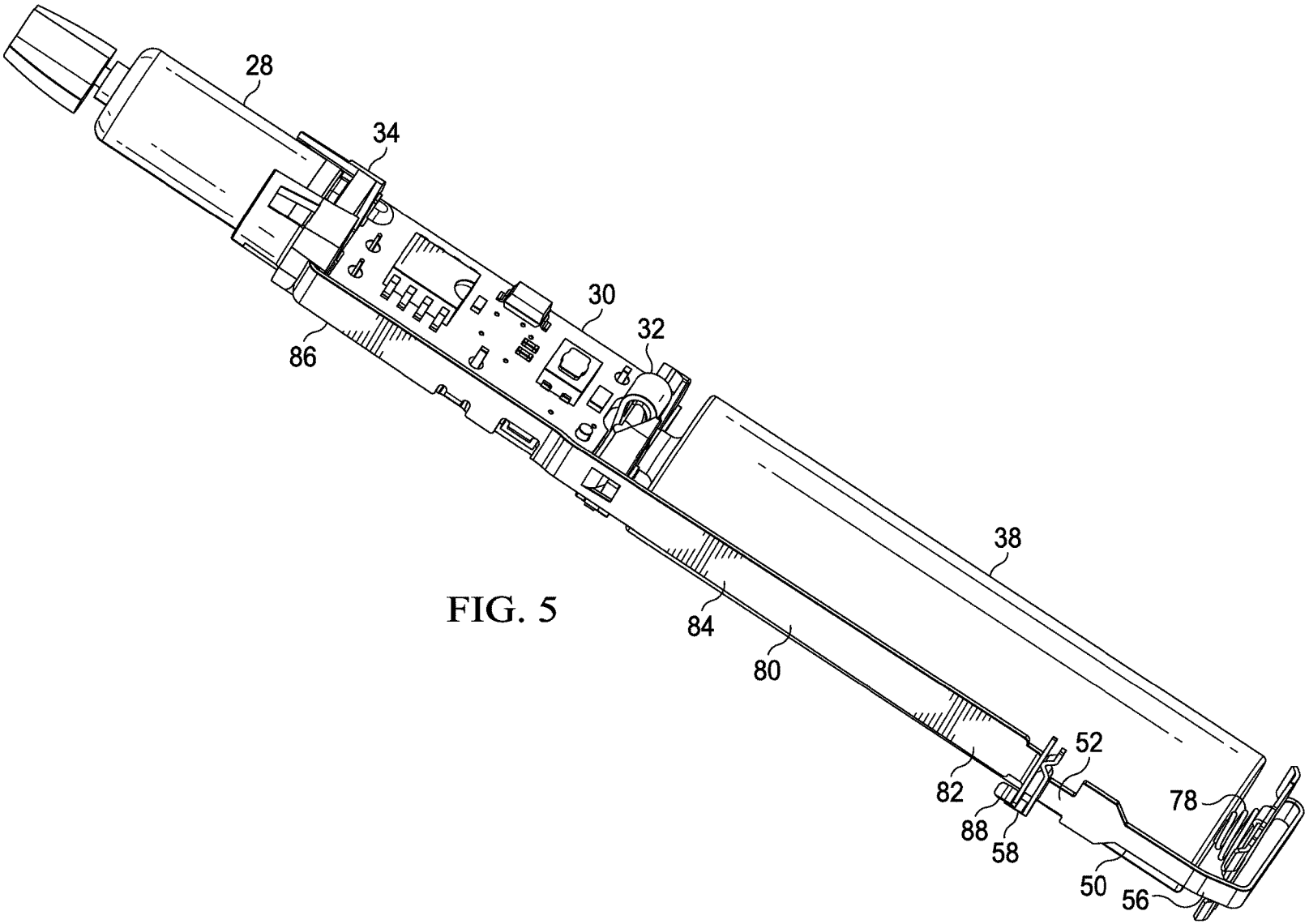

FIG. 5 is a perspective view of the electrical components assembled in the razor handle (grip tube and battery cover).

Figure 6A:
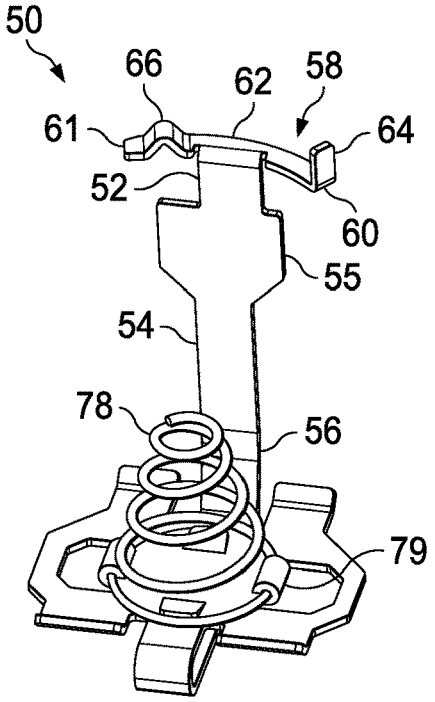
Figure 6B:
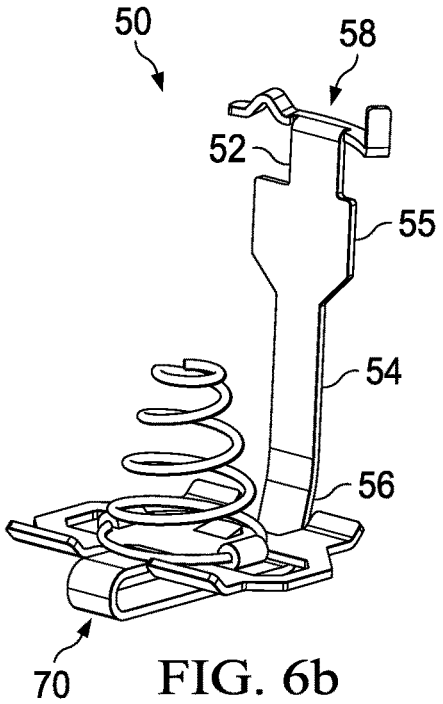
Figure 6C:
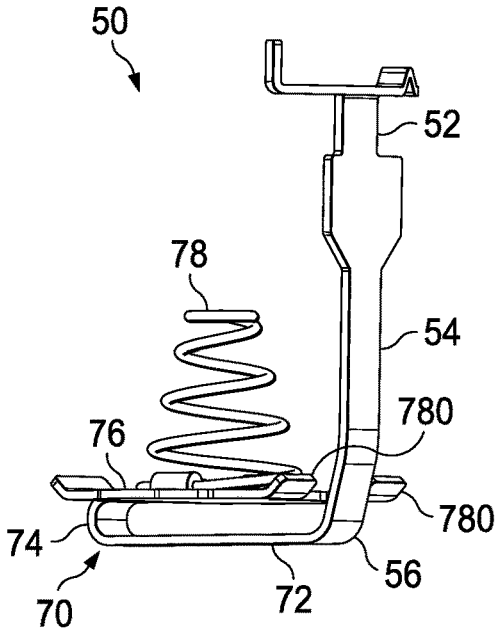

FIGS. 6*a*, 6*b*, and 6*c* are different perspective views of the first conductive component removed from the battery cover.

DETAILED DESCRIPTION OF THE INVENTION

Overall Razor Structure

Referring to FIGS. 1*a* and 1*b*, a razor handle 10 includes a razor head 12, a grip tube 14 (also referred to as a housing 14), and a battery shell 16 (also referred to as a battery cover 16). The razor head 12 includes a connecting structure for mounting a replaceable razor cartridge (not shown) on the handle 10, as is well known in the razor art. The grip tube 14 is constructed to be held by a user during shaving, and to contain the components that provide the battery-powered functionality of the razor, e.g., a printed circuit board and a motor configured to cause vibration. The grip tube 14 is a sealed unit to which the head 12 is fixedly attached, allowing modular manufacturing and providing other advantages which will be discussed below. Referring to FIGS. 2*a* and 2*b*, the battery cover 16 is removably attached to the grip tube 14, so that the user may remove the battery cover 16 to replace the battery 38. Battery cover 16 has a top region 19.

As shown in FIG. 3, the battery cover 16 is removably attached to the grip tube 14 via a threaded connection 40, allowing removal and replacement of the battery 38. Once the battery cover 16 and the grip tube 14 are attached via the threaded connection 40, electrical contact is established between the positive and negative terminals of the battery 38 and the electronic components of the razor through interaction of first and second conductive components 50, 80 assembled in the battery cover cavity 18 and grip tube chamber 11, respectively. As shown in FIG. 3, the first conductive component 50 is assembled in the battery cover 16 and the second conductive component 80 is assembled in the grip tube 14. Both are designed to interact as shown in FIG. 3 as the battery cover 16 and the grip tube 14 are fastened together. The details of the first and second conductive components are fully discussed below.

The interface between the battery cover 16 and grip tube is sealed, e.g., by an O-ring, providing a water-tight assembly to protect the battery and electronics within the razor. The O-ring is generally mounted in groove 21 (FIG. 3) on the grip tube, e.g., by an interference fit. Referring again to FIG. 1*a*, the grip tube 14 includes an actuator button 22 that may be pressed by the user to actuate the battery-powered functionality of the razor via an electronic switch 29 shown in FIG. 4*c*.

Modular Grip Tube Structure

As discussed above, the grip tube 14 (shown in detail in FIG. 2*a*) is a modular assembly, to which the razor head 12 is fixedly attached. The modularity of the grip tube 14 advantageously allows a single type of grip tube to be manufactured for use with various different razor head styles. This in turn simplifies manufacturing of "families" of products with different heads but the same battery-powered functionality. The grip tube is water-tight except for the opening 25 at the end to which the battery cover 16 is attached, and is preferably a single, unitary part. Thus, the only seal that is required to ensure water-tightness of the razor handle 10 is the seal between the grip tube 14 and the battery cover 16 provided by the O-ring. This single-seal configuration minimizes the risk of water or moisture infiltrating the razor handle and damaging the electrical components.

The grip tube 14 contains a subassembly 26, shown in FIG. 4*a*, which includes a vibration motor 28, a printed circuit board (PCB) 30 and a second conductive component 80. The PCB 30 includes an electronic switch 29 and the positive contact 32 for providing battery power to the electronics. These components are assembled to a PCB carrier 34, shown separately in FIG. 4*c*, which is attached to the second conductive component 80 shown separately in FIG. 4*b*. As shown in FIGS. 4*a* and 4*b*, the second conductive component 80 comprises a first end 82, a second end 86 and an elongate section 84 therebetween. The first end 82 includes an L-shaped member 88 comprising a contact surface 92 extending circumferentially, facing the open end 25 of the grip tube chamber 11. The L-shaped member 88 includes a vertical leg 94 at a first end 90 extending axially from the contact surface 92, toward the elongate section 84 forming a second conductive member end stop 94 and a protuberance 96 on the contact surface 92 near a second end 91 of the L-shaped member 88 opposite the first end 82. The function of the protuberance 96 is described in the Battery Cover Attachment section below. The second conductive component second end 86 is attached to the PCB carrier 34 and is in electrical contact with the circuitry of the device.

During assembly of the subassembly 26 shown in FIG. 4*a*, the positive contact 32 is assembled onto a PCB carrier 34 shown in FIG. 4*c*, which is then mounted on the second conductive component second end 86 making electrical contact with the second conductive component 80. Next, the printed circuit board 30 is placed in the PCB carrier 34 (FIG.

4*c*), and the vibration motor 28 is mounted on the PCB carrier 34 with lead wires being soldered onto the printed circuit board 30 to complete the subassembly 26. The subassembly 26 may then be tested prior to assembly into the grip tube 14.

The subassembly 26 is then installed into the grip tube chamber 11 so that it will be permanently retained therein. For example, the elongate section 84 of the second conductive component 80 may include protrusions or arms that engage corresponding recesses in the inner wall 13 of the grip tube 14 in an interference fit. In addition, the L-shaped member 88 of the second conductive component 80 is attached at the open end 25 of the grip tube 14 such that the second conductive component 80 contact surface 92 faces the opening 25 as shown in FIG. 2*a*. For the embodiment shown in FIG. 2*a*, the open end 25 of the grip tube 14 includes a lip 46 that extends beyond the threaded portion 42 of the grip tube 14 and penetrates into the battery cover cavity 18 and extends beyond the threaded portion 44 of the battery cover 16 during attachment of the cover 16 to the grip tube 14 as illustrated in FIG. 3. The second conductive component L-shaped member 88 is attached to the circumferential edge of the lip 46 so that the contact surface is oriented toward the opening 25 and the second conductive component end stop 94 on the L-shaped member is attached to the axial edge of the lip 46 as shown.

The grip tube 14 also includes an actuator button 22. When the actuator button 22 is depressed, the underlying electronic switch 29 is contacted, which activates the circuitry of the PCB 30. Activation may be by a "push and release" on/off action or other desired action, e.g., push on/push off. The electronic switch 29 makes an audible "click" when actuated, giving the user feedback that the device has been correctly turned on. The switch is preferably configured to require a relatively high actuation force applied over a small distance (e.g., at least 4 N applied over about a 0.25 mm displacement). This switch arrangement, combined with the recessed, low profile geometry of button 22, tends to prevent the razor from being accidentally turned on during travel, or inadvertently turned off during shaving. Moreover, the structure of the switch/membrane/actuator member assembly provides the user with good tactile feedback.

Battery Cover Attachment

As discussed above, the battery cover 16 is removably attached to the grip tube 14 via the threaded connection 40 shown in FIG. 3, allowing removal and replacement of the battery 38. For the embodiments shown in FIGS. 2*a*, 2*b*, and 3 the grip tube 14 includes the male threads 42 and the battery cover 16 includes the female threads 44. However, in an alternate embodiment, the grip tube 14 can include the female threaded portion 44 and the battery cover 16 can include the male threaded portion 42. Once the battery cover 16 and the grip tube 14 are attached via threaded connection 40, electrical contact is established between the positive and negative terminals of the battery 38 and the electronic components of the razor handle 10 through interaction of the first and second conductive components 50, 80 assembled in the grip tube 14 and battery cover 16, respectively. The details of the electrical components in the operating condition is shown in FIG. 5.

The grip tube 14 and the battery cover 16 are both made of plastic while the first and second conductive components 50, 80 respectively, are made of a conductive material such as metal. As shown in FIG. 5, the second conductive component second end 86 is attached to the PCB carrier 34 which is in electrical contact with the electric circuitry providing power to the motor 28. The PCB carrier 34 includes positive contact 32 for the battery 38 providing electrical power to the electric circuitry. The negative terminal of the battery is in contact with a battery spring 78 which is connected to the first conductive component second end 56. The electrical circuitry powering the motor 28 is completed by the first conductive component L-shaped member 58 at the first conductive component first end 52 contacting the second conductive component L-shaped member 88 at the second conductive component first end 82.

The first conductive component 50 shown in FIGS. 6*a* through 6*c* comprises a first end 52, a second end 56 and an elongate section 54 therebetween. The elongate section 54 includes flange 55 slidably attached to the interior wall 17 of the battery cover 16. The first end 52 comprises an L-shaped member 58 extending circumferentially about the interior wall 17 of the battery cover cavity 18 proximate the threaded portion 44 at the battery cover open end 35 providing a contact surface 62. Preferably, the contact surface 62 is disposed at the end of the female threaded connection 44 on the interior 17 of the battery cover 16 facing the open end 35 and designed to make contact with the secondary conductive component 80 as the grip tube 14 male threaded portion 42 penetrates the battery cover open end 35 as shown in FIG. 3. The first conductive component L-shaped member 58 shown in FIG. 6*a* comprises a first end 60 and a second end 61 opposite the first end 60. The first end 60 includes a vertical leg 64 extending axially from the contact surface 62 toward the open end 35 of the cavity 18 forming a first conductive component end stop 64 and the second end 61 includes a kinked portion 66 proximate the second end 61 extending axially away from the contact surface 62 toward the battery cover open end 35.

The second end 56 of the first conductive component 50 forms a spring element configured to apply an axial force between the grip tube and battery cover when the first and second conductive components are engaged. In the shown embodiment, the spring element is a U-shaped portion 70 shown in FIG. 6*c*. The U-shaped portion 70 integrates a flexible area into the first conductive component 50. The U-shaped portion 70 has a first leg 72 extending at an angle (preferably radially) away from the elongate section 54 to a bend 74 and a second leg 76 extending from the bend 74 parallel to the first leg 72, back towards the elongate section 54. The second leg 76 includes two spaced arms 780 which extend past the elongate middle section 54 with the elongate middle section 54 passing therebetween. The second leg 76 attached to the interior surface 17 of the battery cover 16 while the first leg 72 is unsupported. A space between the first leg 72 and the bottom of the battery cover cavity 18 enables the first leg 72 to produce a flexible area allowing it to deflect axially and to provide a spring loading effect as the first conductive component 50 slides axially along the interior wall 17 of the battery cover 16. The second leg 76 includes a surface forming a platform opposite the first leg providing a spring holder 79. The spring holder 79 secures the battery spring 78 for biasing the battery 38 in grip tube chamber 11.

During attachment of the battery cover 16 to the grip tube 14 as shown in FIG. 3, the first conductive component contact surface 62 interfaces with the second conductive component contact surface 92, particularly, the kinked portion 66 of the first conductive component contact surface 62 interferes with the second conductive component contact surface 92 as shown in FIG. 3. As shown in FIG. 5, the interaction establishes an electrical connection between the negative terminal of the battery 38 biased by the battery spring 78 and the positive end of the battery 38 in contact with the positive contact 32. In addition, as the battery cover 16 rotates relative to the grip tube, the kinked portion 66 slides circumferentially along the second conductive component contact surface 92 deflecting the first conductive component 50 axially. Eventually the kinked portion 66 slides over the protuberance 96 on the second conductive component contact surface 92 producing a haptical click. This is perceived by the user as an audible click, providing a clear indication that the battery cover 16 has been correctly fastened. This click is the result of the action of the kinked portion 66 of the first conductive component L-shaped member 58 sliding quickly over the protrusion 96 on the second conductive component L-shaped member 88. Either simultaneous with or shortly after the audible click, first conductive component end stop 64 mates with the second conductive component end stop 94 preventing further turning of the cover 16 on the grip tube 14. The cross section depicted in FIG. 3 shows the final closed position for the contact surfaces 62, 92. As shown, the kinked portion 66 of the first conductive component L-shaped member 58 is in contact with the contact surface 92 of the second conductive component L-shaped member 88 contact surface 92 between the second end 91 and the protrusion 96 and the first conductive component end stop 64 contacts the second conductive component end stop 94 preventing further turning of the battery cover 16 on the grip tube 14. This feature can inhibit damage to the parts due to over-tightening.

A number of embodiments of the invention have been described. Nevertheless, it will be understood that various modifications may be made without departing from the spirit and scope of the invention.

For example, while the razors described above include a vibration motor and provide a vibrating functionality, other types of battery-operated functionality may be provided, such as heating.

In some implementations, other types of battery shell attachment may be used. For example, the male and female threaded portions of the battery cover and grip tube may be reversed, so that the battery cover carries the male threaded portion and the grip tube carries the female threaded portion.

Some implementations include some of the features described above, but do not include some or all of the electronic components discussed herein. For example, in some cases the electronic switch may be replaced by a mechanical switch, and the printed circuit board may be omitted.

Accordingly, other embodiments are within the scope of the following claims.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A battery operated razor comprising:

a grip tube having an exterior wall defining a chamber having an interior wall and an open end;

a battery cover having an exterior wall defining a cavity having an interior wall and an open end, the battery cover removably mounted on the grip tube, wherein the grip tube chamber and battery cover cavity are configured to contain one or more batteries, and a closing system comprising a first threaded portion at the grip tube chamber open end and a second threaded portion at the battery cover cavity open end mating with the first threaded portion, the closing system including a first conductive component and a second conductive component, the first conductive component is slidably attached to the interior wall of the battery cover cavity and biased toward a predetermined axial position, the second conductive component is secured to the interior wall of the grip tube chamber;

the first conductive component comprises an L-shaped member extending circumferentially about the interior wall of the battery cover cavity proximate the battery cover open end providing a contact surface facing the open end, the first conductive component L-shaped member comprises a first end and a second end opposite the first end, the first end having a leg extending axially from the contact surface toward the open end of the cavity forming a first conductive component end stop and the second end having a kinked portion proximate the second end extending axially away from the contact surface toward the battery cover open end;

the second conductive component comprises an L-shaped member extending circumferentially about the interior wall of the grip tube chamber and providing a contact surface facing the grip tube chamber open end, the L-shaped member comprises a first end and a second end opposite the first end, the first end having a leg extending axially from the contact surface away from the grip tube chamber open end forming a second conductive component end stop, the second end having a protrusion proximate the second end extending from the contact surface, toward the grip tube chamber open end;

wherein during attachment of the battery cover to the grip tube, the first conductive component contact surface interfaces with the second conductive component contact surface wherein the kinked portion of the first conductive component contact surface interferes with the second conductive component contact surface deflecting the first conductive component axially as the kinked portion slides circumferentially along the contact surface of the second conductive component producing an audible click as the kinked portion slides over the protuberance on the second conductive component contact surface and contacting the first conductive component end stop with the second conductive component end stop subsequent to the audible click.

2. The razor of claim 1 wherein the first conductive component comprises a first end, a second end and an elongate middle section therebetween, wherein the L-shaped member is disposed at the first end, the elongate middle section is slidably attached to the interior wall of the battery cover cavity and the second end includes a spring mechanism biasing the first conductive member toward the predetermined axial position.

3. The razor of claim 2 wherein the spring mechanism comprises an axial spring disposed between the second end of the first conductive member and the battery cover cavity.

4. The razor of claim 2 wherein the spring mechanism is structurally integral with the second end.

5. A battery operated razor comprising:

a grip tube having an exterior wall defining a chamber having an interior wall and an open end; a battery cover having an exterior wall defining a cavity having an interior wall and an open end, the battery cover removably mounted on the grip tube, wherein the grip tube chamber and battery cover cavity are configured to contain one or more batteries, and a closing system comprising a male threaded portion on the exterior wall of the grip tube at the grip tube chamber open end and a female threaded portion on the interior wall of the battery cover cavity open end, the closing system including a first conductive component slidably attached to the interior wall of the battery cover cavity and biased toward a predetermined axial position, and a second conductive component secured to the interior wall of the grip tube chamber, the first conductive component and the second conductive component are configured to interact during engagement of the battery cover with the grip tube wherein the first conductive component moves axially within the battery cover during engagement; the first conductive component comprising a first end, a second end and an elongate middle section therebetween, the elongate middle section is slidably attached to the interior wall of the battery cover, the first end comprises an L-shaped member, the L-shaped member extends circumferentially providing a contact surface toward the open end of the battery cover cavity arranged perpendicular to the elongate middle section, the L-shaped member comprises a leg extending axially toward the open end of the cavity at a first end forming a first conductive member end stop and a kinked portion near a second end opposite the first end rising above the contact surface toward the open end of the cavity, the second end forms a U-shaped portion having a first leg extending radially away from the elongate middle section to a bend and a second leg extending from the bend parallel to the first leg, back towards the elongate middle section, the second leg is attached to the interior surface of the battery cover allowing the first leg to deflect axially and to bias the first conductive component as it moves axially within the battery cover;

the second conductive component comprising an elongate section and a first end secured at the open end of the grip tube chamber, the first end comprising an L-shaped member comprising a contact surface facing the open end of the grip tube chamber and extending circumferentially, the L-shaped member includes a leg extending axially away from the contact surface at a first end forming a second conductive member end stop and a protuberance on the contact surface near a second end of the L-shaped member opposite the first end; wherein during attachment of the battery cover to the grip tube, the first conductive component contact surface interfaces with the second conductive component contact surface wherein the kinked portion of the first conductive component contact surface interferes with the second conductive component contact surface deflecting the first conductive component axially as the kinked portion slides circumferentially along the contact surface of the second conductive component creating an audible click as the kinked portion slides over the protuberance and contacting the first conductive component end stop with the second conductive component end stop subsequent to the audible click.

6. The razor of claim 5 wherein the second conductive component comprises a spring holder, wherein the second leg of the U-shaped portion includes a battery spring biasing one or more batteries within the battery cover cavity and the grip tube chamber into contact with an electrical contact at an end of the grip tube chamber opposite the grip tube chamber open end.

* * * * *